US007680445B2

(12) United States Patent
Kim

(10) Patent No.: US 7,680,445 B2
(45) Date of Patent: Mar. 16, 2010

(54) BELT ASSEMBLY, AND A TRANSFER UNIT AND AN IMAGE FORMING APPARATUS HAVING THE SAME

(75) Inventor: Woo-chan Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 278 days.

(21) Appl. No.: 11/949,815

(22) Filed: Dec. 4, 2007

(65) Prior Publication Data

US 2009/0003894 A1 Jan. 1, 2009

(30) Foreign Application Priority Data

Jun. 27, 2007 (KR) ..... 10-2007-0063891

(51) Int. Cl.
*G03G 15/01* (2006.01)
*G03G 15/08* (2006.01)
*G03G 15/00* (2006.01)

(52) U.S. Cl. ..... 399/302; 399/121; 399/165

(58) Field of Classification Search ..... 399/121, 399/162–165, 302, 303, 308
See application file for complete search history.

(56) References Cited

U.S. PATENT DOCUMENTS 6,141,522 A * 10/2000 Tsuruoka et al. ..... 399/302
6,160,978 A * 12/2000 Tsuruoka et al. ..... 399/165

FOREIGN PATENT DOCUMENTS

| | | |
|---|---|---|
| JP | 62-165676 | 7/1987 |
| JP | 2003-215943 | 7/2003 |
| JP | 2003-255718 | 9/2003 |

* cited by examiner

*Primary Examiner*—Hoang Ngo
(74) *Attorney, Agent, or Firm*—Stanzione & Kim LLP

(57) ABSTRACT

A belt assembly in an image forming apparatus includes a belt which includes a guiding rail on one side, a first roller which includes a receiving part which supports the guiding rail, and a second roller which includes one end which does not interfere with the guiding rail, wherein the belt is supported and rotated by the first roller and the second roller. The intermediate transfer belt has a flatness such that image errors such as crinkles or irregular horizontal bands can be prevented.

25 Claims, 6 Drawing Sheets

BELT ASSEMBLY, AND A TRANSFER UNIT AND AN IMAGE FORMING APPARATUS HAVING THE SAME

CROSS-REFERENCE TO RELATED APPLICATIONS

This application claims priority under 35 U.S.C. §119 (a) of Korean Patent Application No. 10-2007-0063891, filed on Jun. 27, 2007, in the Korean Intellectual Property Office, the disclosure of which is incorporated herein by reference in its entirety.

BACKGROUND OF THE INVENTION

1. Field of the Invention

The present general inventive concept relates to an image forming apparatus, and more particularly, to a belt assembly of a color image forming apparatus using an intermediate transfer belt.

2. Description of the Related Art

In general, conventional color image forming apparatuses have a belt assembly to develop images using a series of developers of different colors.

Belt assemblies are designed to rotate continuously so that conveyed print material may receive images of a variety of colors from one or more photoconductive media. If there is a single photoconductive medium, the number of times the belt assembly rotates is equal to the number of different colors required. If the number of the photoconductive media is equal to the number of different colors, the print material conveyed by the belt assembly can receive an entire color image with a single rotation.

Usually, the belt assembly includes a frame, a driving roller, an idle roller, a first transfer roller, and an intermediate transfer belt.

The driving roller, the idle roller, the first transfer roller, and the intermediate transfer belt are mounted rotationally on the frame.

The driving roller receives power to rotate the intermediate transfer belt. The idle roller is supported by elastic members having the same elastic coefficient, and together with the driving roller provides the intermediate transfer belt with a fixed level of tension.

First and second guiding members are installed on the static side of the driving roller and the idle roller. The first and second guiding members have a guiding groove which houses a guiding rail formed on the intermediate transfer belt to prevent the intermediate transfer belt from meandering. The intermediate transfer belt can thus perform continuous rotation without meandering with the guiding rail inserted in the guiding groove.

The first transfer roller is disposed between the driving roller and the idle roller so that the photoconductive medium and the intermediate transfer belt form a transfer nip.

The intermediate transfer belt is rotated and supported by the driving roller and the idle roller, and receives an image from the photoconductive medium. The intermediate transfer belt includes the guiding rail to eliminate meandering as described above, and a sensor hole which senses the location of the intermediate transfer belt.

Generally, the intermediate transfer belt with the sensor hole is attached with a reinforcing tape of equal width to prevent the intermediate transfer belt from being damaged due to cracks occurring around the sensor hole.

The reinforcing tape has consistent thickness, so a non-contact space is created between the reinforcing tape and the driving roller at the contact area between the driving roller and the reinforcing tape which is not created at the contact area between the driving roller and the guiding rail since that contact area does not include the reinforcing tape.

If the intermediate transfer belt has an uneven surface and rotates rapidly, the contact area of the intermediate transfer belt between the driving roller and the reinforcing tape is partially deformed, so waves or troughs occur. The waves or troughs deform the transfer nips formed on the photoconductive medium and the first transfer roller, so that the flatness of the transfer nips is damaged and image errors such as irregular horizontal bands occur.

SUMMARY OF THE INVENTION

The present general inventive concept provides a belt assembly to resolve image errors such as irregular horizontal bands by improving a flatness of an intermediate transfer belt, a transfer unit, and an image forming apparatus having the same.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a belt assembly in an image forming apparatus including a belt which includes a guiding rail disposed on a static side portion of the belt, a first roller which includes a receiving part to support the guiding rail, and a second roller which includes an end which does not interfere with the guiding rail, wherein the belt is supported and rotated by the first roller and the second roller.

One of the first roller and the second roller of the belt assembly may be an idle roller and the other may be a driving roller, and the belt may be an intermediate transfer belt.

The first roller of the belt assembly may be an idle roller and the second roller may be a driving roller, and the second roller may be shorter than the first roller.

The belt of the belt assembly may also include a guide member to guide the rotation of the belt which is disposed on a driving side of the belt opposite the first side. The guide member to guide the rotation of the belt may be a reinforcing tape which may be disposed on an inside surface of the belt.

A reinforcing tape escape groove may be disposed on the second roller of the belt assembly to face and to receive the reinforcing tape.

A width of the reinforcing tape escape groove of the second roller may be substantially identical to a width of the reinforcing tape, and a depth of the reinforcing tape escape groove may be greater than the thickness of the reinforcing tape. The reinforcing tape escape groove may be disposed on a driving side of the driving roller.

The reinforcing tape may be disposed on an external surface of the belt.

The receiving part of the first roller may be a guiding member which is disposed on the first roller to face and to receive the guiding rail of the belt.

The first roller may be elastically supported by a first elastic member and a second elastic member which each have different elastic coefficients. The first elastic member may support a driving side of the first roller which is opposite the receiving part and the second elastic member may support a static side of the first roller which is located on the same side as the receiving part. The elastic coefficient of the first elastic member may be lower than that of the second elastic member.

A first transfer roller may be disposed between the first roller and the second roller, and the first transfer roller may have an Asker C Scale hardness of between 47 and 52.

The belt of the belt assembly may further include a sensor hole disposed in proximity to a guide member disposed on a driving side portion of the belt which is opposite the static side portion of the belt.

A length of the first roller of the belt assembly may be greater than a length of the second roller.

A free end on a static side of the second roller may not interfere with the belt guiding rail.

The belt of the belt assembly may further include a guide member disposed on a driving side portion of the belt.

An end of the second roller may include a groove to face and to receive the guide member.

The foregoing and/or other aspects and utilities of the present general inventive concept may also be achieved by providing a belt assembly in an image forming apparatus including an intermediate transfer belt including a guiding rail disposed on a first side and a reinforcing tape disposed on an opposite second side on a surface of the intermediate transfer belt where the guiding rail is disposed, wherein the intermediate transfer belt is supported and rotated by an idle roller having two ends and a driving roller, the two ends of the idle roller are supported respectively by a first elastic member and a second elastic member each of which have different elastic coefficients, and the idle roller further includes a receiving part which supports the guiding rail, and the driving roller does not interfere with the guiding rail, and further wherein a reinforcing tape escape groove is disposed on the driving roller to face and to receive the reinforcing tape and having a width and a depth equal to or greater than a width and a thickness, respectively, of the reinforcing tape.

The foregoing and/or other aspects and utilities of the present general inventive concept may also be achieved by providing a belt assembly in an image forming apparatus including an intermediate transfer belt including a guiding rail disposed on a first side of the intermediate transfer belt, wherein the intermediate transfer belt is supported and rotated by an idle roller having two ends and a driving roller, further wherein the ends of the idle roller are respectively supported by a first elastic member and a second elastic member each of which have different elastic coefficients, and further wherein the idle roller includes a receiving part to support and to receive the guiding rail, and further wherein the driving roller does not interfere with the guiding rail, and a reinforcing tape is disposed on a second side of the intermediate transfer belt opposite the guiding rail on a surface of the intermediate transfer belt such that the idle roller and the driving roller do not interfere with each other.

The foregoing and/or other aspects and utilities of the present general inventive concept may also be achieved by providing a transfer unit in an image forming apparatus, the transfer unit including a frame, a belt assembly including a driving roller and an idle roller which are rotatably mounted on the frame, and an intermediate transfer belt which is supported and rotated by the driving roller and the idle roller and includes a guiding rail disposed on a side of the intermediate transfer belt, such that the driving roller does not interfere with the guiding rail.

The foregoing and/or other aspects and utilities of the present general inventive concept may also be achieved by providing an image forming apparatus including a photoconductive medium to form an electrostatic latent image thereon, a developing unit to form an image on the electrostatic latent image, and a transfer unit to receive developer attached to the photoconductive medium to form an image wherein the transfer unit includes a frame, and a belt assembly including a driving roller and an idle roller which are rotatably mounted on the frame, and an intermediate transfer belt which is supported and rotated by the driving roller and the idle roller, and includes a guiding rail disposed on a side of the intermediate transfer belt, wherein the driving roller does not interfere with the guiding rail.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
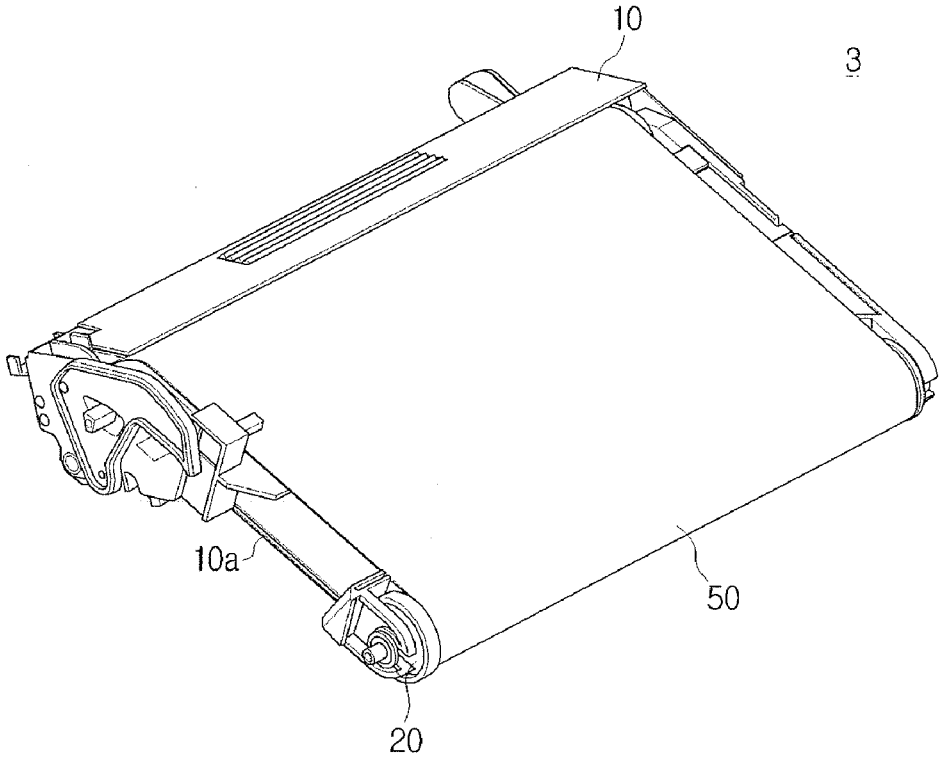
FIG. 1 is a perspective view illustrating a transfer unit according to an exemplary embodiment of the present general inventive concept.
Figure 2:
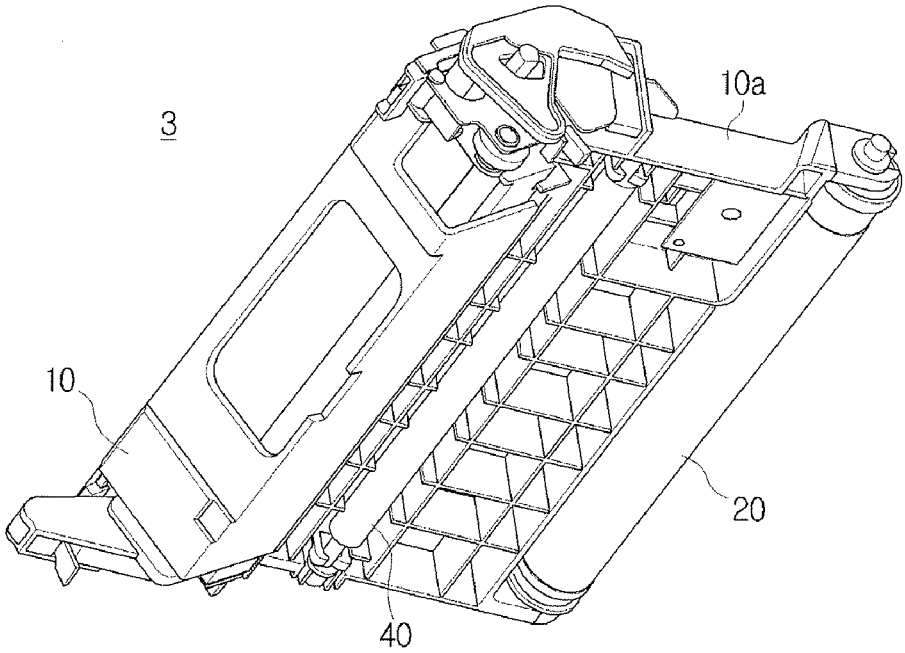
FIG. 2 is a bottom view illustrating the transfer unit of FIG. 1 with an intermediate transfer belt removed.
Figure 3:
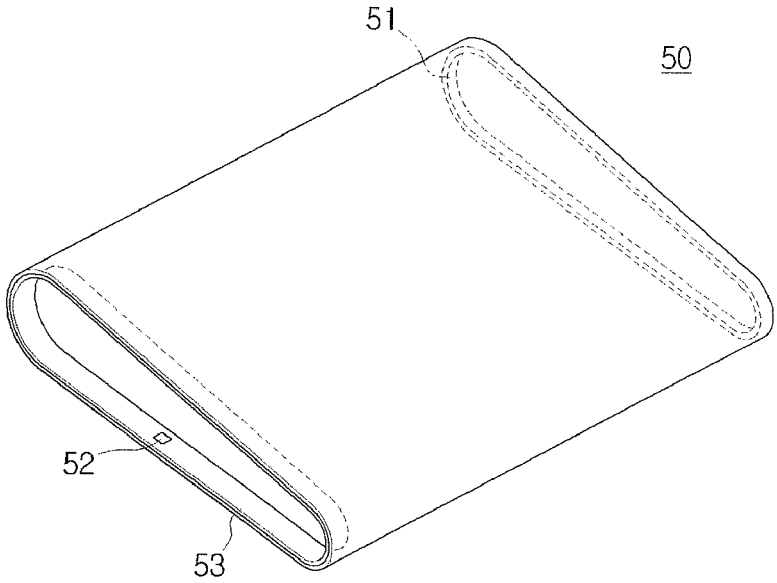
FIG. 3 is a perspective view illustrating only the intermediate transfer belt of FIG. 1.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

As illustrated in FIG. 1, a transfer unit 3, in an image forming apparatus according to an exemplary embodiment of the present general inventive concept includes a frame 10, and an intermediate transfer belt 50 which performs caterpillar rotation inside the frame 10. A belt assembly as a sub-unit of the transfer unit 3 does not include frame 10, but includes intermediate transfer belt 50 and additional elements, as described below.

A driving roller 20 or 120 (refer to FIGS. 1, 2, and 6-11) according to a respective exemplary embodiment of the present general inventive concept, an idle roller 30 (refer to FIGS. 6, 8 and 10), and a first transfer roller 40 (refer to FIGS.

2 and 12) are rotatably mounted on the frame 10. Those rollers can rotate inside the frame 10.

The detailed structure of the driving roller 20 or 120 according to the exemplary embodiments of the present general inventive concept will be described later.

Figure 6:
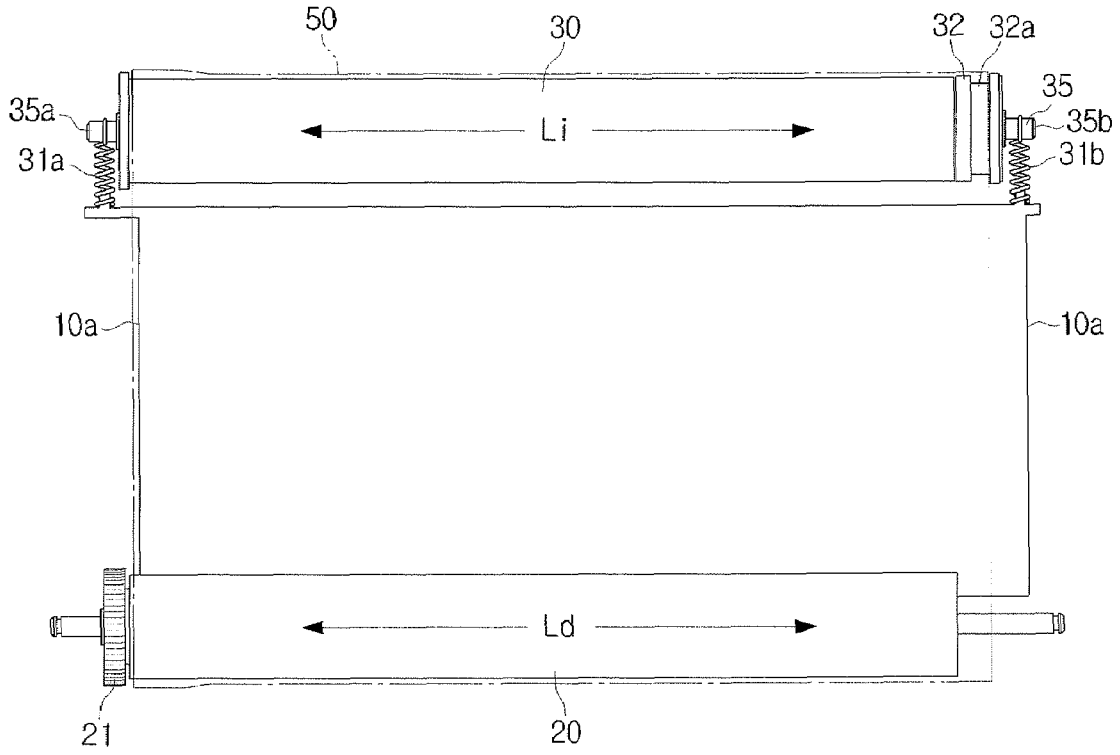
FIG. 6 is a top view illustrating a belt assembly according to an exemplary embodiment of the present general inventive concept.
Figure 7:
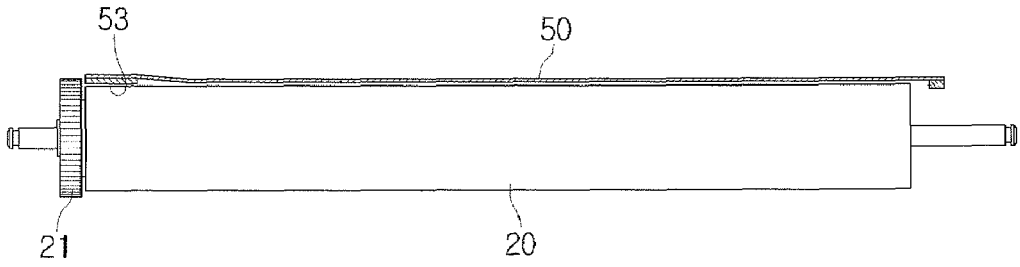
FIG. 7 is a cross sectional view illustrating a driving roller illustrated in FIG. 6.
Figure 8:
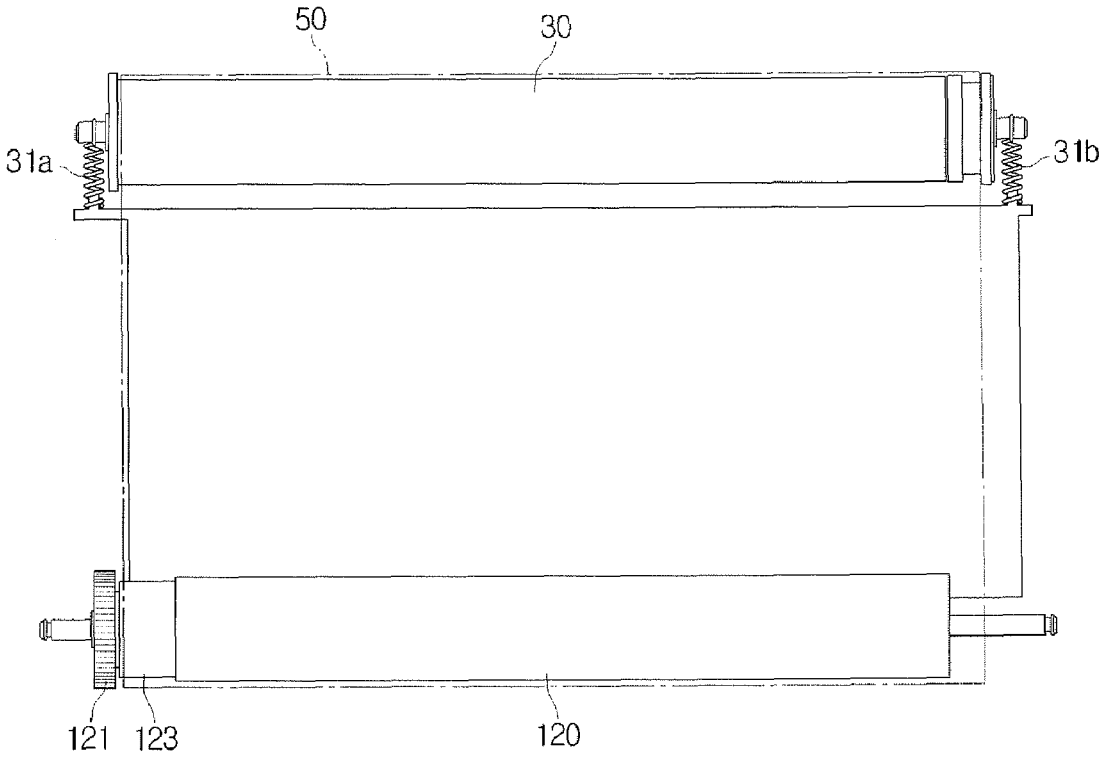
FIG. 8 is a top view illustrating a belt assembly according to an exemplary embodiment of the present general inventive concept.
Figure 10:
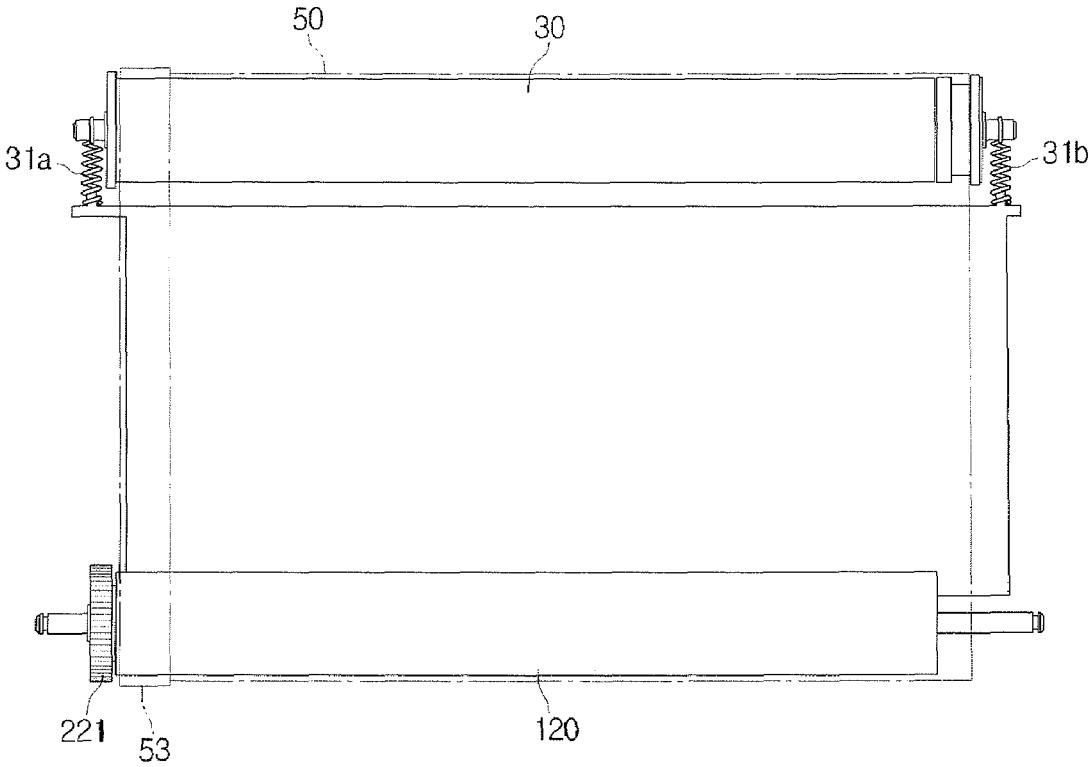
FIG. 10 is a top view illustrating a belt assembly according to an exemplary embodiment of the present general inventive concept.

Referring to FIGS. 6, 8, and 10, the idle roller 30, which is disposed on an opposite end of the transfer unit 3 from the driving roller 20 or 120, is supported by a first elastic member 31*a* and a second elastic member 31*b*, which have different elastic coefficients, and together with the driving roller 20 or 120 of the respective exemplary embodiments provides the intermediate transfer belt 50 with a fixed degree of tension.

The first elastic member 31*a* may support a driving side of the idle roller 30, that is, the driving side of the idle roller 30 is disposed on a same side on which a driving gear 21 is connected to the driving roller 20 or 120.

The second elastic member 31*b* may support a static side of the idle roller 30, that is, the static side of the idle roller 30 is a second end of idle roller 30 which is disposed opposite to the first end of the idle roller 30 with respect to a main rotating body of the idle roller 30 and is disposed on the same side of an opposite end of the driving roller 20 or 120 with respect to a main rotating body of the driving roller 20 or 120.

One end of the first elastic member 31*a* may attach to a body 10*a* (refer to FIG. 6) of frame 10 and the opposite end of the first elastic member 31*a* may attach to a first end 35*a* of a shaft 35 of the idle roller 30. Similarly, one end of the second elastic member 31*b* may attach to a body 10*a* of frame 10 and the opposite end of the second elastic member 31*b* may attach to a second end 35*b* of the shaft 35 of the idle roller 30. The elastic coefficient of the first elastic member 31*a* may be lower than that of the second elastic member 31*b*.

A guiding member 32 is formed on the static side of the idle roller 30 to form a space to receive a guiding rail 51 formed on the intermediate transfer belt 50. The guiding member 32 guides the movement of the intermediate transfer belt 50 by shepherding the guiding rail 51.

The guiding member 32 forms a guiding groove 32*a* which is sized to fit and to receive the guiding rail 51 therein. The intermediate transfer belt 50 rotates when the guiding rail 51 is received by and in contact with the guiding groove 32*a*.

The first transfer roller 40 (refer to FIG. 2) is disposed between the driving roller 20 or 120 and the idle roller 30 in order for the photoconductive medium 2*a* (refer to FIG. 12) and the intermediate transfer belt 50 to form a transfer nip. The first transfer roller 40 may have an Asker C Scale hardness of between 47 and 52.

The intermediate transfer belt 50 is supported by the driving roller 20 or 120 according to a respective exemplary embodiment of the present general inventive concept and the idle roller 30, and rotates continuously. Transfer nips are generated on the photoconductive medium and the first transfer roller 40, and the intermediate transfer belt 50 receives an image from the photoconductive medium.

The guiding rail 51 (refer to FIGS. 4, 5 and 9) is formed on the intermediate transfer belt 50 to face the static side of the driving roller 20 or 120 and the idle roller 30. This structure can maintain fixed transfer nips.

Figure 4:
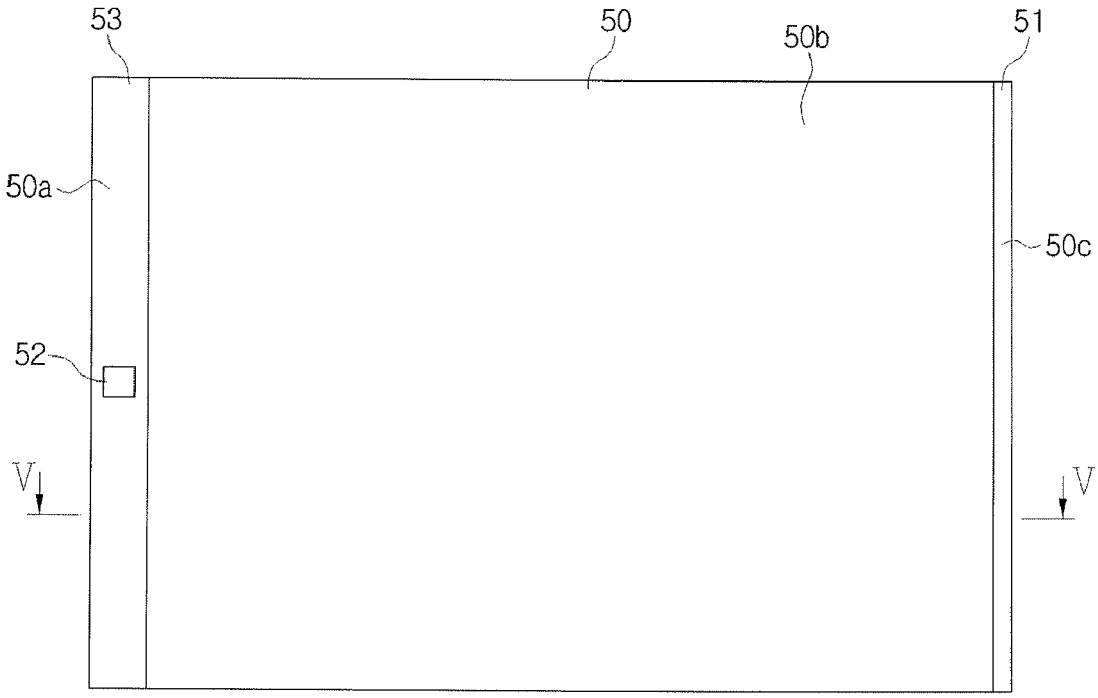
FIG. 4 is an unfolded view illustrating the intermediate transfer belt of FIG. 3.
Figure 5:
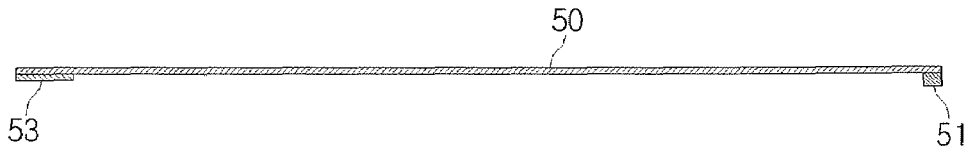
FIG. 5 is a cross sectional view illustrating the intermediate transfer belt of FIG. 3.

Referring to FIG. 4, the intermediate transfer belt 50 has a driving side portion 50*a* having a first thickness and having the reinforcing tape 53 disposed thereon, a main portion 50*b* having a second thickness, and a static side portion 50*c* having a third thickness and having the guiding rail 51 disposed thereon. A sensor hole 52 is formed to penetrate the driving side portion 50*a* of the intermediate transfer belt 50 which is the side of intermediate transfer belt 50 furthest from the guiding rail 51 to allow the image forming device 15 (refer to FIG. 12) to sense the location of the intermediate transfer belt 50. A reinforcing tape 53 is attached along a side of the intermediate transfer belt 50 to support the intermediate transfer belt 50 and to prevent the intermediate transfer belt 50 from being transformed or damaged due to the presence of sensor hole 52, but the reinforcing tape 53 does not cover the sensor hole 52. The reinforcing tape 53 has consistent width and does not encroach from a non-image area on the intermediate transfer belt 50.

Figure 9:
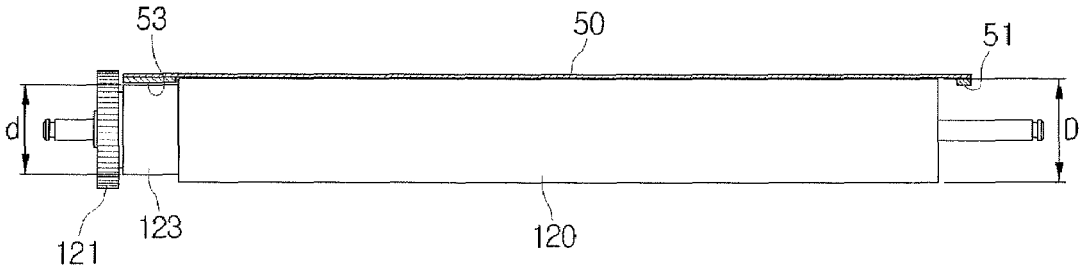
FIG. 9 is a cross sectional view illustrating a driving roller illustrated in FIG. 8.
Figure 11:
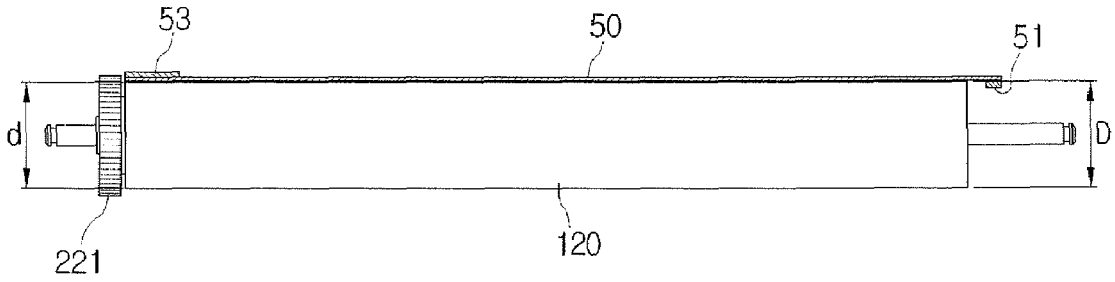
FIG. 11 is a cross sectional view illustrating a driving roller illustrated in FIG. 10.

The present general inventive concept is divided into the three exemplary embodiments depending on the presence or absence of the reinforcing tape 53, and the location of the reinforcing tape 53. Referring to FIG. 6, in the first exemplary embodiment, the reinforcing tape 53 is absent. Referring to FIGS. 8 and 9, in the second exemplary embodiment, the reinforcing tape 53 is on the same surface that the guiding rail 51 is formed on. Referring to FIGS. 10 and 11, in the third exemplary embodiment, the reinforcing tape 53 is on the surface opposite that on which the guiding rail 51 is formed.

As illustrated in FIG. 6, in the driving roller 20 of the first exemplary embodiment of the present general inventive concept, a driving gear 21 is disposed on the driving side of the driving roller 20. The driving side receives power from a driving force (not illustrated) to rotate driving roller 20 which in turn causes transfer intermediate belt 50 to rotate. The driving roller 20 has a length $L_d$ which is shorter than the length $L_i$ of the idle roller 30 which allows the static side of the driving roller 20 to avoid interference between the second end of the static side of the driving roller 20 and the guiding rail 51 (refer to FIG. 5). As a result, the second end of the driving roller 20 of the static side of the driving roller 20 is disposed in close proximity to the guiding rail 51 but is formed as a free end that does not interfere with the guiding rail 51.

As illustrated in FIGS. 8 and 9, in the driving roller 120 of the second exemplary embodiment of the present general inventive concept, a driving gear 121 is disposed on the driving side of the driving roller 120. The driving side receives power from a driving force (not illustrated). A reinforcing tape 53 is attached to the opposite side of the driving roller 120 from the guiding rail 51 on the same surface of the intermediate transfer belt 50 as the guiding rail 51. The reinforcing tape 53 can guide the rotation of the intermediate transfer belt 50 as the guiding rail 51 does.

A reinforcing tape escape groove 123 is formed on the driving roller 120 to face the reinforcing tape 53. The reinforcing tape escape groove 123 has the same width as the reinforcing tape 53 and may have a depth greater than the thickness of the reinforcing tape 53. Furthermore, the reinforcing tape escape groove 123 may have a width greater than the width of the reinforcing tape 53, provided the width is not great enough to intrude on the image forming area of the intermediate transfer belt 50.

For example, in the image forming apparatus having the transfer unit 3 according to the present general inventive concept, if the intermediate transfer belt 50 has a thickness of 0.065 mm, the reinforcing tape 53 has a thickness of 0.08 mm and a width of 11 mm, and the guiding rail has a thickness of 1.45 mm and a width of 4 mm, it is preferable in one embodiment that the reinforcing tape escape groove 123 has a depth (D-d, refer to FIG. 9) of 1 mm and a width of 11 mm, which is greater than the thickness of and the same width as that of the reinforcing tape 53.

In the structure of this example, the reinforcing tape 53 does not contact the driving roller 120 due to the depth of reinforcing tape escape groove 123. Accordingly, this structure prevents the intermediate transfer belt 50 from being deformed on the driving side of the driving roller 120.

Finally, FIGS. 10 and 11 illustrate the driving roller 120 of the third exemplary embodiment of the present general inventive concept.

The reinforcing tape 53 to prevent the intermediate transfer belt 50 from being damaged due to the sensor hole 52 is attached on an opposite surface from the surface where the guiding rail 51 is formed, that is, on the outer surface of the intermediate transfer belt 50. Accordingly, the driving roller 120 does not contact the reinforcing tape 53, so the intermediate transfer belt 50 is not deformed. Consequently, the third exemplary embodiment does not require a reinforcing tape escape groove as illustrated in the second exemplary embodiment.

As described above with reference to FIGS. 6, 8 and 10, the driving roller 20 or 120 is shorter than the idle roller 30 in order to prevent the static side of the driving roller 20 or 120 in the transfer unit 3 according to the first through third exemplary embodiments of the present general inventive concept from interfering with the guiding rail 51.

Furthermore, although not illustrated in the drawings, the driving roller 20 or 120 may be the same length as the idle roller 30 if the driving roller 20 or 120 does not interfere with the guiding rail 51 by engraving in the driving roller 20 or 120 at the contact location between the driving roller 20 or 120 and the guiding rail 51. As a result, this has the same effect regarding non-interference between the guiding rail 51 and the driving roller 20 or 120 as described above in regard to the first through third exemplary embodiments.

The operation of a transfer unit 3 of an image forming apparatus 15 (refer to FIG. 12) according to the present general inventive concept is described using FIGS. 8 and 9 in connection with the second exemplary embodiment.

If the image forming apparatus 15 starts operating, the driving roller 120 receives power from a driving motor (not illustrated) and rotates, and the intermediate transfer belt 50 starts rotating continuously due to rotation of the driving roller 120.

The guiding rail 51 on the static side of the intermediate transfer belt 50 is coupled with the guiding groove 32*a* (refer to FIG. 6) formed next to the guiding member 32 on the idle roller 30 so as to guide the movement of the intermediate transfer belt 50. As a result, deformation of intermediate transfer belt 50 by any deviation or skew can be prevented.

As illustrated in FIG. 9, the static side end of the driving roller 120 is shorter than the end of the intermediate transfer belt 50 having the guiding rail 51 in order to avoid interference between the driving roller 120 and the guiding rail 51. The side of intermediate transfer belt 50 held in position by the guiding member 32 of the idle roller 30 can freely slip past the static side of the driving roller 120 which is formed as a free end.

If the static side of the driving roller 120 is formed as the free end, the free end can somewhat solve possible deformation of the intermediate transfer belt 50, such as caused by waves or troughs. In other words, as the intermediate transfer belt 50 freely slips by the free end of driving roller 120, belt crinkle, which occurs when both ends of the intermediate transfer belt 50 are solidly fixed, can be prevented. Therefore, transfer nips generated between the photoconductive medium 2*a* (refer to FIG. 12) and the intermediate transfer belt 50 maintain uniform flatness.

The reinforcing tape escape groove 123 is formed on the driving side of the driving roller 120 to avoid interference with the reinforcing tape 53, so that the reinforcing tape 53 does not contact the driving roller 120. Consequently, as transformation of the intermediate transfer belt 50 due to the thickness of the reinforcing tape 53 is prevented, this can also alleviate one of the causes of belt crinkle.

If the driving roller 120 is constructed as described above, a different tension is inherently applied to the driving side than to the static side of the idle roller 30 because the guiding member 32 is formed on the static side of the idle roller 30, but the driving roller 120 does not have an element corresponding to the guiding member 32.

In order to solve the inherent imbalance of tension, the first elastic member 31*a* and the second elastic member 31*b*, which each support a respective end of the idle roller 30, may have different elastic coefficients. The different elastic coefficients may be referred to as being different tensions. In particular, the static side of the idle roller 30 which is supported by the second elastic member 31*b* receives more force than the driving side of the idle roller 30 because the guiding member 32 guides the guiding rail 51. Therefore, the elastic coefficient of the second elastic member 31*b* is set greater than that of the first elastic member 31*a* so as to provide even tension to the driving side and the static side of idle roller 30.

There are no substantial differences between the operation of the transfer unit 3 in the first and third exemplary embodiments and that in the second exemplary embodiment. The differences are that the first exemplary embodiment excludes the reinforcing tape 53, and the third exemplary embodiment excludes the reinforcing tape escape groove 123 because the reinforcing tape 53 is attached to the external surface of the intermediate transfer belt 50. However, transfer unit 3 of the first and third exemplary embodiments has the same structure as the second exemplary embodiment in that the static side of the driving roller 120 is formed as a free end to prevent deformation of the intermediate transfer belt 50, such as crinkle.

Figure 12:
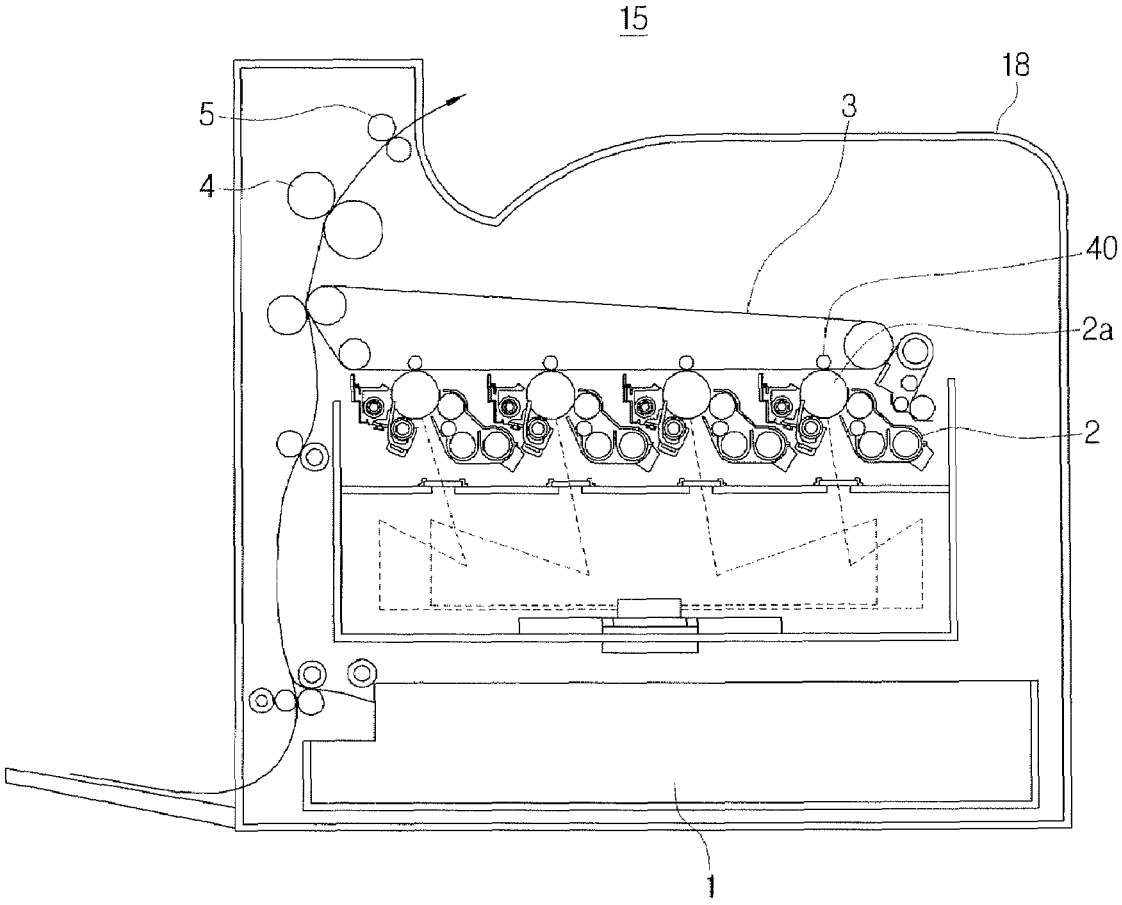
FIG. 12 illustrates an image forming apparatus according to an exemplary embodiment of the present general inventive concept.

As illustrated in FIG. 12, an image forming apparatus 15 according to the first through third exemplary embodiments of the present general inventive concept includes a main body 18, a photoconductive medium 2*a*, a developing unit 2, and a transfer unit 3 as described above.

The main body 18 includes a feeding unit 1 which accommodates a printing medium such as paper, the developing unit 2, the transfer unit 3, the fixing unit 4, and the printing medium discharging unit 5.

If the image forming apparatus 15 starts printing, the paper on the feeding unit 1 is transferred to the developing unit 2, and the developing unit 2 transfers developer on an electrostatic latent image generated on the photoconductive medium 2*a* based on image information so that an visible image is generated. The photoconductive medium 2*a* transfers the visible image to the transfer unit 30 on transfer nips which are formed in an area contacting the transfer unit 3 according to the present general inventive concept.

The image forming apparatus 15 in FIG. 12, which is an example of a color image forming apparatus, includes a photoconductive medium 2*a* according to each color. Four colors are printed with one rotation of the intermediate transfer belt 50, so high-speed printing is supported. In this process, a color image is formed on paper, the fixing unit 4 fixes the color image on the paper using heat and pressure, and the paper is discharged to the outside of the main body through the printing medium discharging unit 5.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

As can be appreciated from the above description, the flatness of the intermediate transfer belt prevents image errors such as crinkles or irregular horizontal bands.

What is claimed is:

1. A belt assembly in an image forming apparatus, the belt assembly comprising:

a belt which comprises a guiding rail disposed on a static side portion of the belt;

a first roller which comprises a receiving part to support the guiding rail; and a second roller which comprises an end which does not interfere with the guiding rail, wherein the belt is supported and rotated by the first roller and the second roller.

2. The belt assembly of claim 1, wherein one of the first roller and the second roller is an idle roller and the other is a driving roller, and the belt is an intermediate transfer belt.

3. The belt assembly of claim 2, wherein the first roller is an idle roller and the second roller is a driving roller, and wherein the second roller is shorter than the first roller.

4. The belt assembly of claim 1, wherein the belt further comprises a guide member to guide the rotation of the belt which is disposed on a driving side of the belt.

5. The belt assembly of claim 4, wherein the guide member to guide the rotation of the belt is a reinforcing tape.

6. The belt assembly of claim 5, wherein the reinforcing tape is disposed on an inside surface of the belt.

7. The belt assembly of claim 6, wherein a reinforcing tape escape groove is disposed on the second roller to face and to receive the reinforcing tape.

8. The belt assembly of claim 7, wherein a width of the reinforcing tape escape groove is substantially identical to a width of the reinforcing tape and a depth of the reinforcing tape escape groove is greater than a thickness of the reinforcing tape.

9. The belt assembly of claim 7, wherein the reinforcing tape escape groove is disposed on a driving side of the driving roller.

10. The belt assembly of claim 5, wherein the reinforcing tape is disposed on an external surface of the belt.

11. The belt assembly of claim 1, wherein the receiving part is a guiding member which is disposed on the first roller to face and to receive the guiding rail of the belt.

12. The belt assembly of claim 1, wherein the first roller is elastically supported by a first elastic member and a second elastic member which each have different elastic coefficients.

13. The belt assembly of claim 12, wherein the first elastic member supports a driving side of the first roller which is opposite the receiving part and the second elastic member supports a static side of the first roller which is located on the same side as the receiving part.

14. The belt assembly of claim 13, wherein the elastic coefficient of the first elastic member is lower than that of the second elastic member.

15. The belt assembly of claim 1, further comprising:

a first transfer roller disposed between the first roller and the second roller, and the first transfer roller has an Asker C Scale hardness of between approximately 47 and approximately 52.

16. The belt assembly of claim 1, wherein the belt further comprises:

a sensor hole disposed in proximity to a guide member disposed on a driving side portion of the belt which is opposite the static side portion of the belt.

17. The belt assembly of claim 1, wherein a length of the first roller is greater than a length of the second roller.

18. The belt assembly of claim 1, wherein a free end on a static side of the second roller does not interfere with the belt guiding rail.

19. The belt assembly of claim 1, wherein a driving gear is coupled to an end of the second roller.

20. The belt assembly of claim 1, wherein the belt further comprises:

a guide member disposed on a driving side portion of the belt.

21. The belt assembly of claim 20, wherein an end of the second roller includes a groove to face and to receive the guide member.

22. A belt assembly in an image forming apparatus, comprising:

an intermediate transfer belt comprising a guiding rail disposed on a surface on a static side of the intermediate transfer belt and a reinforcing tape disposed on an opposite driving side on the surface of the intermediate transfer belt, wherein:

the intermediate transfer belt is supported and rotated by an idle roller having two ends and a driving roller:

the two ends of the idle roller are supported respectively by a first elastic member and a second elastic member each of which have different elastic coefficients, and:

the idle roller further comprises a receiving part which supports the guiding rail, and the driving roller does not interfere with the guiding rail, and:

a reinforcing tape escape groove is disposed on the driving roller to face and to receive the reinforcing tape and has a width and a depth equal to or greater than a width and a thickness, respectively, of the reinforcing tape.

23. A belt assembly in an image forming apparatus, comprising:

an intermediate transfer belt comprising a guiding rail disposed on a first side of the intermediate transfer belt, wherein:

the intermediate transfer belt is supported and rotated by an idle roller having two ends and a driving roller, further wherein:

the two ends of the idle roller are respectively supported by a first elastic member and a second elastic member each of which have different elastic coefficients, and further wherein:

the idle roller further comprises a receiving part to support and to receive the guiding rail, and further wherein:

the driving roller does not interfere with the guiding rail, and a reinforcing tape is disposed on a second side of the intermediate transfer belt opposite the guiding rail on a surface of the intermediate transfer belt such that the idle roller and the driving roller do not interfere with each other.

24. A transfer unit in an image forming apparatus, the transfer unit comprising:

a frame; and a belt assembly comprising:

a driving roller and an idle roller which are rotatably mounted on the frame; and an intermediate transfer belt which is supported and rotated by the driving roller and the idle roller and comprises a guiding rail disposed on a side of the intermediate transfer belt, such that the driving roller does not interfere with the guiding rail.

25. An image forming apparatus, comprising:

a photoconductive medium to form an electrostatic latent image thereon;

a developing unit to form an image on the electrostatic latent image; and a transfer unit to receive developer disposed on the photoconductive medium to form an image, wherein the transfer unit comprises:

a frame; and a belt assembly comprising:

a driving roller and an idle roller which are rotatably mounted on the frame; and an intermediate transfer belt which is supported and rotated by the driving roller and the idle roller, and comprises a guiding rail disposed on a side of the intermediate transfer belt, wherein the driving roller does not interfere with the guiding rail.

* * * * *